US007165708B2

(12) United States Patent
Motono et al.

(10) Patent No.: US 7,165,708 B2
(45) Date of Patent: Jan. 23, 2007

(54) MOTOR STAPLER

(75) Inventors: Yasutaka Motono, Tokyo (JP); Koutarou Koba, Tokyo (JP)

(73) Assignee: Max Co., Ltd., Tokyo (JP)

( * ) Notice: Subject to any disclaimer, the term of this patent is extended or adjusted under 35 U.S.C. 154(b) by 0 days.

(21) Appl. No.: 10/511,745

(22) PCT Filed: Apr. 18, 2003

(86) PCT No.: PCT/JP03/05004

§ 371 (c)(1),
(2), (4) Date: Apr. 5, 2005

(87) PCT Pub. No.: WO03/089206

PCT Pub. Date: Oct. 30, 2003

(65) Prior Publication Data

US 2005/0161487 A1 Jul. 28, 2005

(30) Foreign Application Priority Data

Apr. 19, 2002 (JP) ..... 2002-117831
Jul. 23, 2002 (JP) ..... 2002-214263

(51) Int. Cl.
*B27F 7/17* (2006.01)

(52) U.S. Cl. ..... 227/2; 227/131; 227/120; 227/137

(58) Field of Classification Search ..... 227/2, 227/3, 5, 7, 131, 120, 129, 137, 156; 270/58.08, 270/58.09; 173/2, 183
See application file for complete search history.

(56) References Cited

U.S. PATENT DOCUMENTS 4,978,045 A * 12/1990 Murakami et al. ..... 227/1
5,230,457 A * 7/1993 Hiroi et al. ..... 227/2
5,354,042 A * 10/1994 Coombs ..... 270/58.14
5,823,415 A * 10/1998 Udagawa et al. ..... 227/120
5,975,396 A * 11/1999 Manabe ..... 227/2
6,062,454 A * 5/2000 Morishige et al. ..... 227/2
RE36,923 E * 10/2000 Hiroi et al. ..... 227/2

(Continued)

FOREIGN PATENT DOCUMENTS

JP 4-128648 A 4/1992

(Continued)

*Primary Examiner*—John Sipos
*Assistant Examiner*—Michelle Lopez
(74) *Attorney, Agent, or Firm*—Morgan, Lewis & Bockius, LLP

(57) ABSTRACT

An electric stapler comprises a feed mechanism for sequentially feeding a staple from a magazine loaded with a plurality of staples to a striking portion, a striking mechanism for striking the staple fed to the striking portion toward sheets of paper by a driver plate, a clincher mechanism for bending a staple leg struck by the driver plate and penetrated through the sheets of paper along a backside of the sheets of paper, a drive mechanism for driving the feed mechanism, the striking mechanism and the clincher mechanism by the electric motor, a detection mechanism placed in contact with a rotary member provided in the drive mechanism and for detecting a consumed amount of the drive mechanism, and an indicator mechanism for indicating a consumed amount detected by the detection mechanism, thus making it possible to detect an endurance life of the electric stapler.

11 Claims, 17 Drawing Sheets

U.S. PATENT DOCUMENTS

| | | | | |
|---|---|---|---|---|
| 6,216,935 | B1 * | 4/2001 | Oussani et al. | 227/6 |
| 6,325,267 | B1 * | 12/2001 | Yoshie et al. | 227/2 |
| 6,899,258 | B2 * | 5/2005 | Haramiishi | 227/2 |
| 6,918,580 | B2 * | 7/2005 | Obregon et al. | 270/58.09 |
| 6,948,224 | B2 * | 9/2005 | Coombs et al. | 29/407.01 |

FOREIGN PATENT DOCUMENTS

| | | | |
|---|---|---|---|
| JP | 9-322483 | A | 12/1997 |
| JP | 2000-186774 | A | 7/2000 |
| JP | 2002-104722 | A | 4/2002 |

* cited by examiner

MOTOR STAPLER

TECHNICAL FIELD

The present invention relates to an electric stapler driven by an electric motor and installed in an apparatus, such as a copier or a facsimile machine, to automatically bind copied or facsimile-received sheets of paper, and more particularly to an electric stapler provided with a cumulative-drive indicator mechanism.

Meanwhile, the invention is concerned with an electric stapler having a rotation cumulative amount indicator mechanism to indicate a rotation cumulative amount of the rotary shaft.

BACKGROUND ART

There are known a copier or a facsimile machine where an electric stapler for automatically binding copied or facsimile-received sheets of paper is installed therein. The electric stapler of built-in type has a feed mechanism for feeding the staple contained in a cartridge from the cartridge to a striking portion, a striking mechanism for striking the staple fed to the striking portion from the striking portion toward sheets of paper, and a clincher mechanism for bending the leg of the staple struck by the striking mechanism and penetrated through the sheets of paper along a backside of the sheets of paper. Furthermore, the electric stapler is provided with a drive mechanism for driving the feed, striking and clincher mechanisms due to a rotation force of one or a plurality of electric motors. The electric motors and the drive mechanism are designed to satisfy a predetermined endurance-life limit value of the electric stapler.

The copier or the like installing the electric stapler is adapted to thoroughly count the cumulative number of copied sheets. Based on the cumulative copy count, the endurance life is decided for the main components of the copier, and used as a measure of copier maintenance in exchanging components. However, in the electric stapler installed in the copier or the like, the copied sheets of paper to be fastened are not constant in the number. Besides, because there are cases of applying automatic stapling and not applying stapling, there is not always a proportional relationship between copy count and the number of operations of the electric stapler. With certain copy count, it is impossible to decide the endurance life of the electric stapler.

In order to grasp a cumulative operation state of the electric stapler installed in the conventional apparatus, there is a need to visually decide a wear degree of the rotary shaft, electric motor or other parts after the electric stapler is removed from the copier and disassembled during maintenance inspection. It is extremely difficult for the serviceman to detect an endurance life of the electric stapler by means of the copier used by the user. For this reason, it is a usual practice, in frequent cases, to make an exchange significantly prior to reaching the endurance-life limit value of the electric stapler.

Meanwhile, conventionally, even where the serviceman who visited his/her client makes certain of the motor rotary shaft on the actual machine during maintenance inspection, there is difficulty in deciding in what degree the rotation cumulative amount of rotary shaft is neared to its limit value. There are many cases to make an exchange when significantly far from the limit value. For example, for the electric stapler mounted on a copier, there are cases of exchanges at a use even a half of a limit value because of no provision of indicator means.

DISCLOSURE OF THE INVENTION

The problem of the present invention is to provide a rotation cumulative amount indicator device capable of easily deciding in what degree the rotation cumulative amount of the rotary shaft is neared to its limit value, and an electric stapler provided with the same device.

Furthermore, it is a problem of the invention to provide an electric stapler capable of detecting an endurance life externally of the electric stapler in terms of a cumulative-drive time of the electric stapler installed in a copier or the like without removing the electric stapler from the copier. Meanwhile, it is a problem to provide an electric stapler capable of detecting an endurance life on the electric stapler singly even when removed from the copier.

In order to solve the foregoing problem, an electric stapler of the present invention comprises: a feed mechanism for sequentially feeding a staple from a magazine loaded with a plurality of staples to a striking portion; a striking mechanism for striking the staple fed to the striking portion toward sheets of paper by a driver plate; a clincher mechanism for bending a staple leg struck by the driver plate and penetrated through the sheets of paper, along a backside of the sheets of paper; a drive mechanism for driving at least any one of the feed mechanism, the striking mechanism and the clincher mechanism by at least one electric motor; a detection mechanism placed in contact with a rotary member provided in the drive mechanism and for detecting a consumed amount of the drive mechanism; and an indicator mechanism for indicating a consumed amount detected by the detection mechanism.

Furthermore, the detection mechanism may be urged onto the rotary member.

Meanwhile, the indicator mechanism may be placed in contact with the detection mechanism and for indicating a displacement of the detection mechanism from an initial contact position at a start of using the electric stapler.

Furthermore, in order to solve the foregoing problem, the invention comprises a rotary shaft, a rod provided movable vertically with respect to the rotary shaft, and urging means for urging the rod toward the rotary shaft and putting the rod in contact with an outer surface of the rotary shaft, wherein at least one of the outer surface of rotary shaft and the rod is formed of a soft material softer than the other, to detect and indicate a rotation cumulative amount of the rotary shaft from a wear amount of the soft material.

According to the above structure, the rod is urged toward the rotary shaft by the urging means. Because the soft material is worn in the use over a long term, the rod moves in position toward the rotary shaft. By detecting and indicating the amount of movement, it is easy to decide in what degree the rotation cumulative amount of the rotary shaft is neared to its limit value. In this case, the rod is satisfactorily formed of a soft material at and a vicinity of a contact region with the rotary shaft.

Meanwhile, in the invention, where the rod only is formed of a soft material, the rotary shaft has a cutout in a part of an outer peripheral surface contacting with the rod. Because there is a possibility that wear less proceeds with a mere contact of the rod with the rotary shaft, the provision of a cutout in a rotary-shaft outer surface as noted above applies an impact to the rod each time the cutout is passed, thus accelerating the amount of wear of the rod. It is easy to decide whether or not the rotation cumulative amount of the rotary shaft is neared to its limit value.

Furthermore, the invention is an electric stapler comprising a cartridge containing a stack of sheet staples, a feed mechanism for feeding the sheet staple from the cartridge to a striking portion, a striking mechanism for striking from the striking portion a staple of the sheet staple fed by the feed mechanism by reciprocal movement, and a clincher mechanism for bending the tip of a staple struck by the striking mechanism, wherein the rotation cumulative amount indicating means is mounted as means for indicating an cumulative amount of the rotary shaft of the drive mechanism for driving the above mechanisms.

Meanwhile, in order to solve the above problem, a cumulative-drive indicator mechanism of an electric stapler of the invention is an electric stapler comprising a feed mechanism for sequentially feeding a staple from a magazine loaded with a plurality of staples to a striking portion, a striking mechanism for striking a staple fed to the striking portion toward sheets of paper by a driver plate, a clincher mechanism for bending a staple leg driven by the driver plate and penetrated through the sheets of paper along a backside of the sheets of paper, and a drive mechanism for driving the feed mechanism, striking mechanism and clincher mechanism by an electric motor, wherein within the electric motor is provided an actuator formed with a pointer end to be displaced due to a wear of a brush of the electric motor, the pointer end of the actuator being arranged visible from an outer surface of the electric motor, a limit mark being indicated on the outer surface of the electric motor correspondingly to a position of the pointer end at a time that the brush is displaced to an endurance limit along a direction of displacement of the pointer end.

BRIEF DESCRIPTION OF THE DRAWINGS

FIG. 15(A) is an explanatory view showing a state that a staple is formed into a squared-U form while

Incidentally, the reference in the figures, 1 is an electric stapler, 60 is a rotary shaft, 60A is a cutout, 61 is a frame, 65 is a rod, 67 is a gauge lever, 72 is a spring, 74 is a scale, 801 is an electric stapler, 814 is an electric motor, 820 is an output shaft, 821 is a rectifier, 823 is a brush, 824 is an elastic piece, 825 is a motor case, 826 is a terminal, 827, 837 are an cumulative-drive indicator mechanism, 828, 838 are an actuator, 829, 839 are a pointer end, 830, 840 are an aperture, 831, 841 are a limit mark, 836, 842 are a scale line.

BEST MODE FOR CARRYING OUT THE INVENTION

Hereunder, embodiments of the present invention will be explained according to the drawings.

(Embodiment 1)

Figure 1:
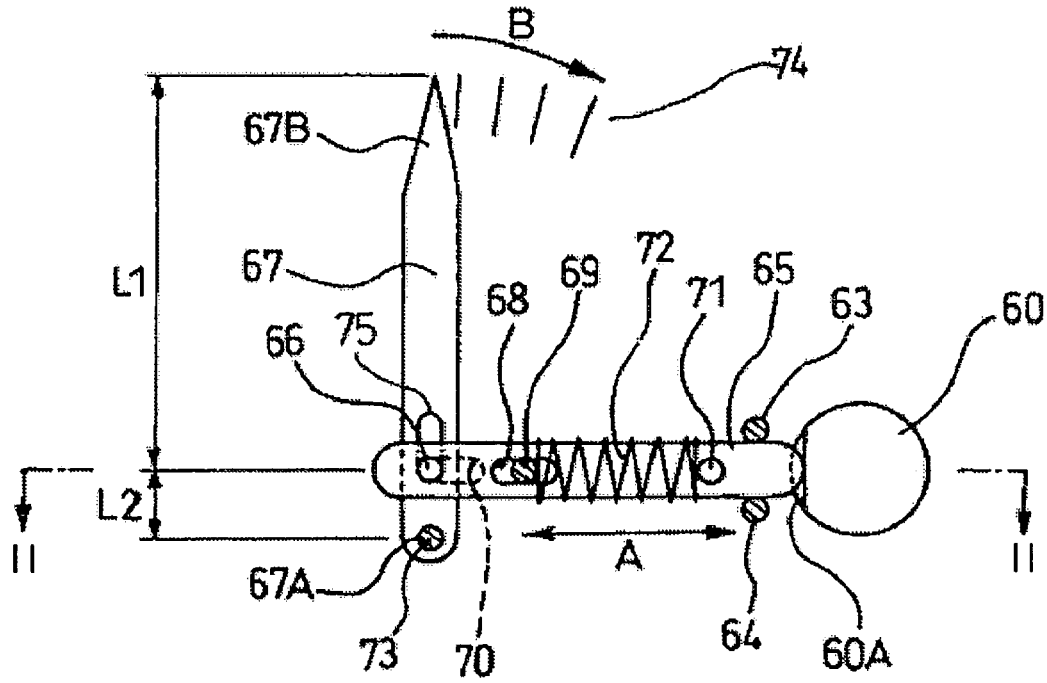
FIG. 1 is a front view of a rotation cumulative amount indicator device according to embodiment 1 of the present invention.
Figure 2:
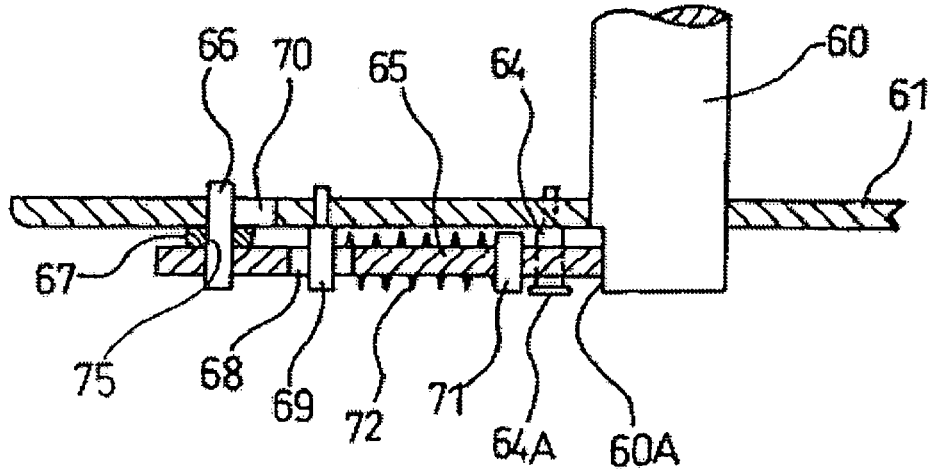
FIG. 2 is a sectional view taken along line II—II in FIG. 1.

FIG. 1 is a front view of a rotation cumulative amount indicator device used on an electric stapler according to the present invention, while FIG. 2 is a sectional view taken along the line II—II in FIG. 1. A rotary shaft (rotary member) 60 is rotatably supported on a frame 61. The rotary shaft 60 has a tip protruding outside of the frame 61, which tip has a peripheral surface partly cut in a planar form, thus forming a cutout 60A. On the frame 61, guide pins 63, 64 are fixed in positions close to the tip of the rotary shaft 60, to arrange a rod between the guide pins 63, 64. The rod 65 is supported, at a side close to the rotary shaft 60, by the guide pins 63, 64 and coupled, at an opposite side remote from the rotary shaft 60, to a gauge lever 67 through a coupling pin 66 fixed on the rod 65.

The rod 65 is formed with an elongate hole 68 at an intermediate portion thereof. The elongate hole 68 is engaged with a guide pin 69 fixed on the frame 61. Meanwhile, the frame 61 is formed with an elongate hole 70. The elongate hole 70 is engaged with a tip of the coupling pin 66. The coupling pin 66 is movable in the elongate hole 70. The rod 65 is allowed to move in a direction of arrow A in the figure by the elongate hole 68 guided on the guide pin 69 and both side ends guided on the guide pins 63, 64. Incidentally, the guide pin 63, 64 has a tip provided with a flange (reference 64A in FIG. 2) in order to prevent the rod 65 from disengaging from the guide pin 63, 64.

The rod 65 is fixed with a pin 71, at a side close to the rotary shaft 60. A spring 72 is provided around the rod 65, at between a tip of the guide pin 69 and the pin 71. Because the guide pin 69 is fixed on the frame 61, the spring 72 urges the pin 71. This urges the rod 65 toward the rotary shaft 60 so that the tip thereof is always kept in contact with an outer surface of the rotary shaft 60. Incidentally, a rubber, an elastic resin or the like can be employed in place of the spring 72.

In the present embodiment, the rod 65 is formed of a soft material at and around a contact region with the rotary shaft 60. Namely, the rod 65 is generally made of steel, however, solely at and around the contact region with the rotary shaft 65, the rod 65 is formed of a soft material, e.g. aluminum or brass. Incidentally, the rod 65 in its entirety can be formed of a soft material, e.g. aluminum or brass.

In the gauge lever 67, an elongate hole 75 is formed in which the coupling pin 66 is inserted. Meanwhile, the gauge lever 67 has one end formed with a base 67A and the other end with a pointer hand 67B (pointer), respectively. The base 67A is attached onto the frame 61 by a pin 73 so that the gage lever 67 can rotate freely about the pin 73. The indicator hand 67B is sharpened at its tip. On the frame 61, a scale 74 indicative of a rotation cumulative amount is denoted corresponding to the sharpened point. The distance L1 between a tip of the pointer hand 67B and the coupling pin 66 is set fully greater than a distance L2 between the coupling pin 66 and the pin 73.

In the above construction, in case the rotary shaft 60 is rotated over a long term, a wear takes place in the tip of the rod 65. Namely, because the rod 65 is formed of a soft material at and around the contact region and moreover it is urged on the rotary shaft 60 by the spring 72, the soft material is worn due to rotation of the rotary shaft 60. At this time, because the cutout 60A is formed in the rotary shaft 60, impact is applied to the rod 65 each time the cutout 60A is passed to accelerate the wear of the soft material.

Figure 3:
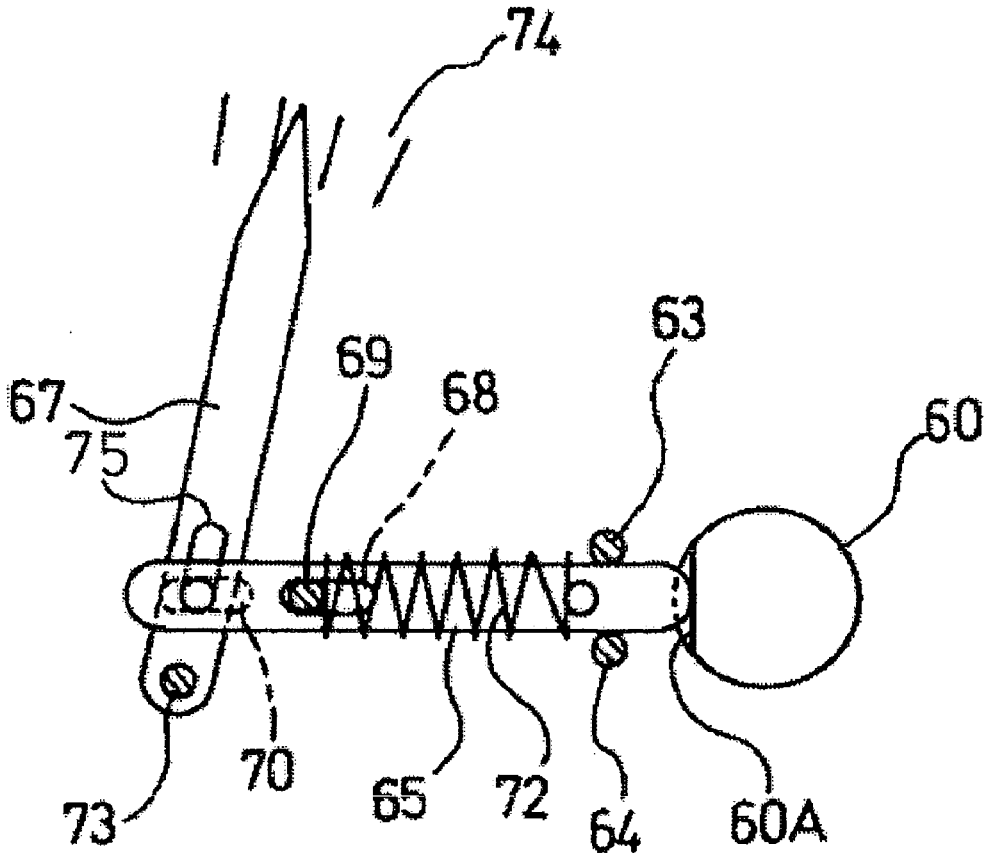
FIG. 3 is a view showing a manner indicating a rotation cumulative amount.

Because the rod 65 is always biased toward the rotary shaft 60 by the spring 72, the soft material if worn causes the rod 65 to move approaching the rotary shaft 60 as guided by the guide pins 63, 64 and the guide pin 69. Thereupon, the coupling pin 66 displaces along the elongate holes 70, 75. Pulled by the displacement, the gauge lever 67 rotates in a direction of arrow B about the pin 73 into a position as shown in FIG. 3, for example. Thus, by reading a point of the pointer hand 67B on the scale 74, it is easy to know to what degree is reached the rotation cumulative amount of rotary shaft 60. In this case, because the distance L1 is set fully greater than the distance L2, the pointer hand 67B largely displaces even when the rigid material is slightly worn in amount and hence the rod 65 is less in movement.

Incidentally, although the present embodiment had the cutout 60A in the rotary shaft 60, the cutout 60A may be omitted when using a soft material to be worn extremely readily.

(Embodiment 2)

Figure 4:
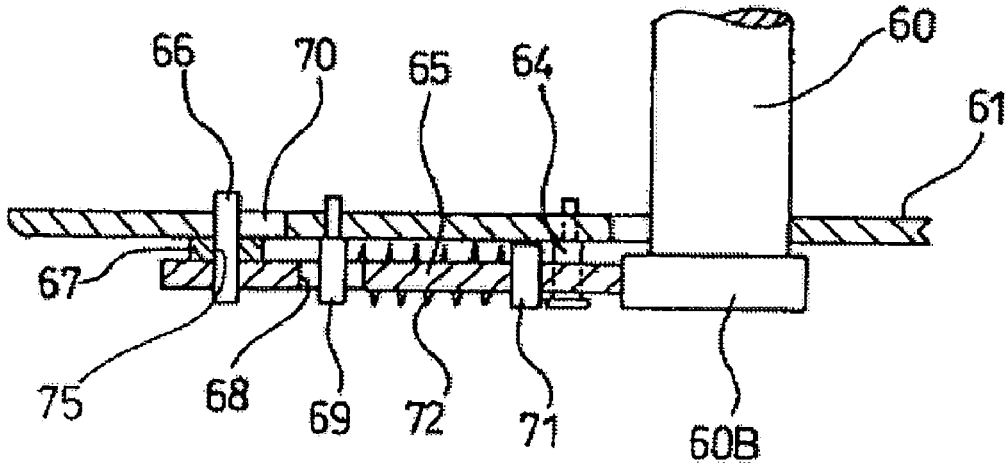
FIG. 4 is a sectional view corresponding to FIG. 2, showing embodiment 2 of the invention.
Figure 5:
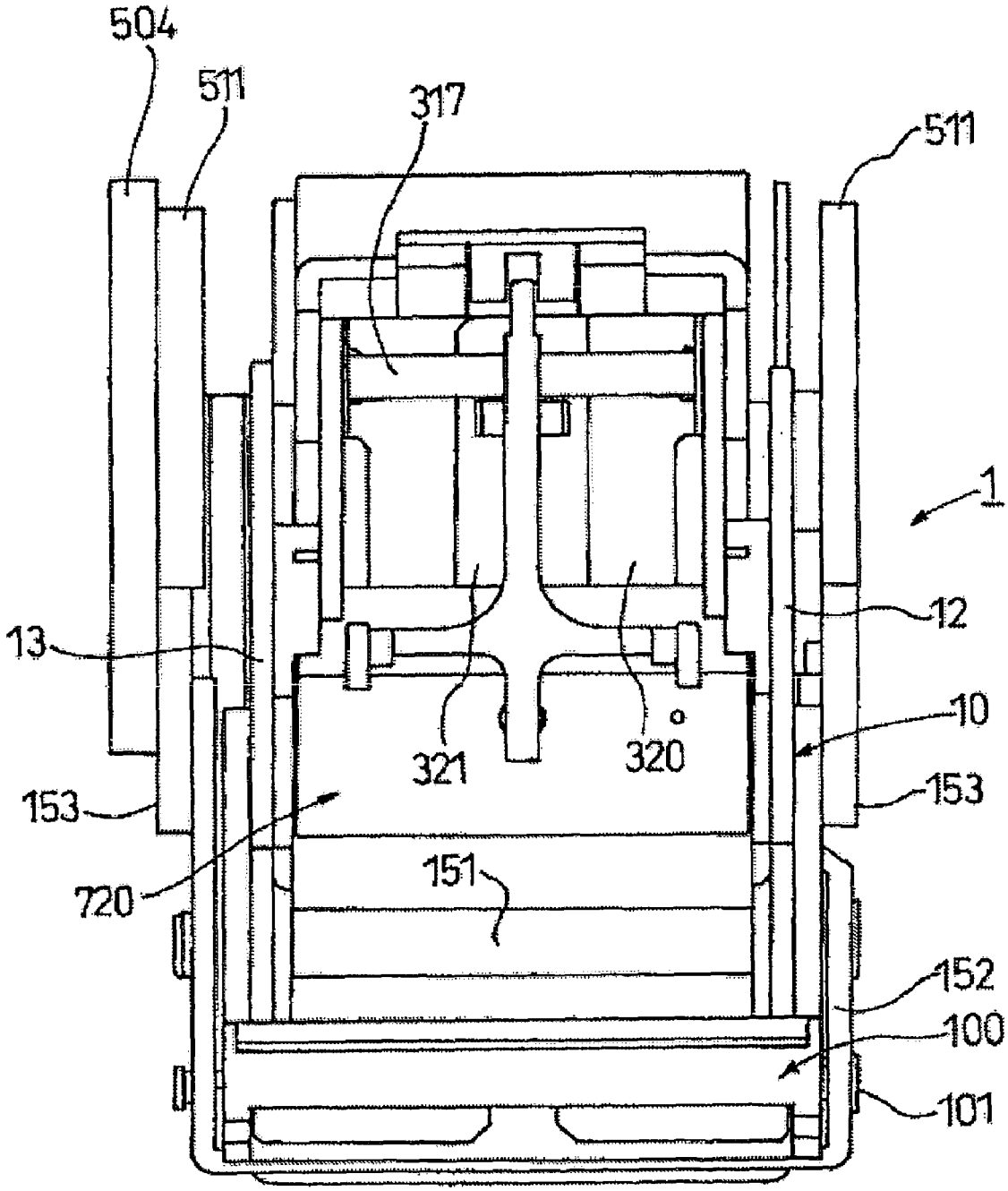
FIG. 5 is a front view showing an exterior of an electric stapler according to embodiment 3 of the invention.
Figure 6:
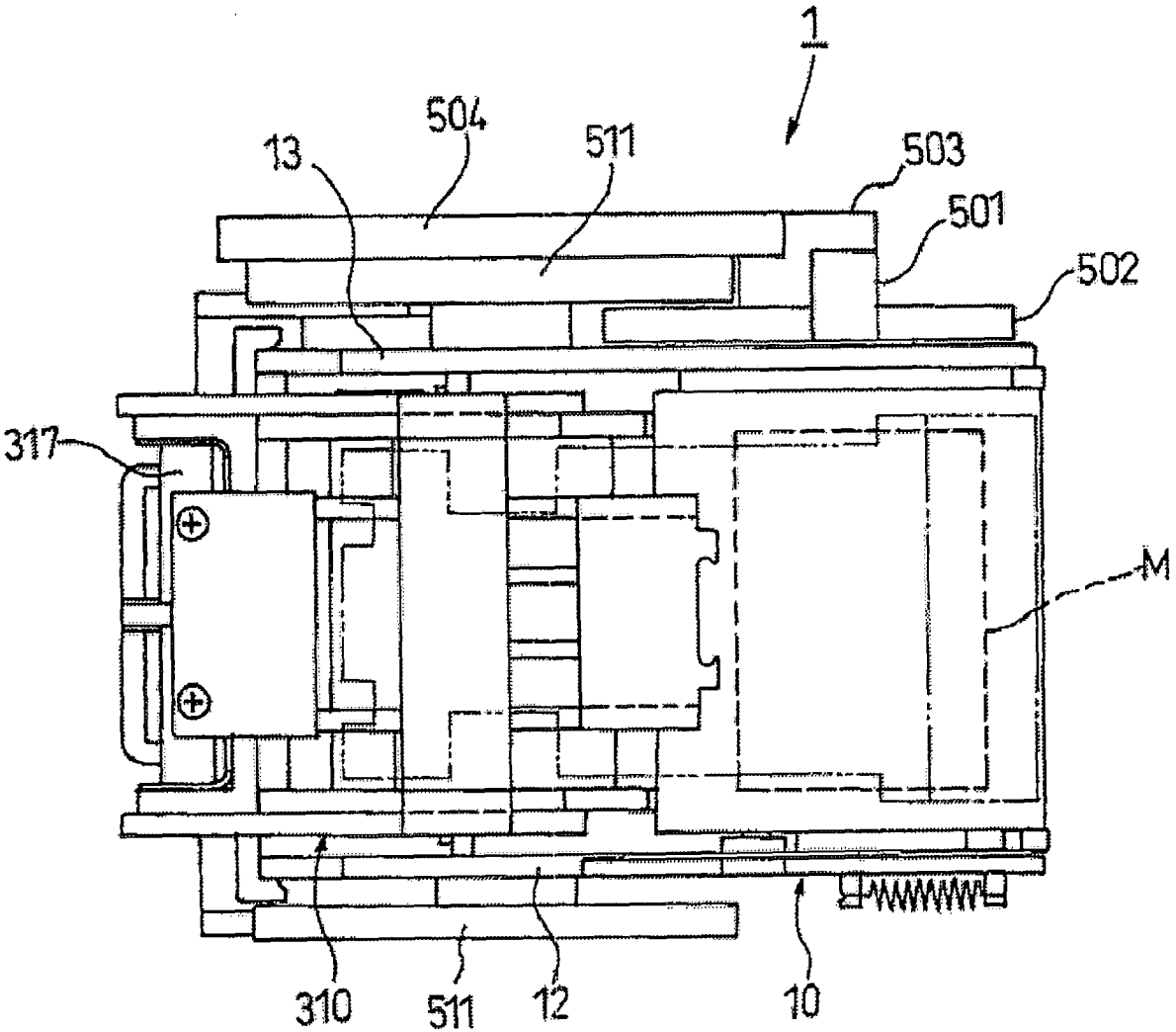
FIG. 6 is a plan view of the electric stapler shown in FIG. 5.

Now, FIG. 4 shows embodiment 2 of the invention which is a figure corresponding to FIG. 2. This embodiment is provided with a soft material on the side of rotary shaft (rotary member) 60. Namely, the rotary shaft 60 is provided with an increased diameter portion 60B of a soft material at a tip thereof. The rod 65 is not formed of a soft material but made of steel in its entirety.

In also this embodiment, when the rotary shaft 60 is rotated over a long term, the increased diameter portion 60B is worn to thereby move the rod 65 in a manner approaching the rotary shaft 60. Similarly to the case of embodiment 1, by reading a position of the pointer hand (pointer) 67B over the scale 74, it is easy to know to what degree the rotation integrate amount of rotary shaft 60 has reached.

Incidentally, the soft material can be provided at both the rod 65 and the rotary shaft 60.

(Embodiment 3)

Now, explanation is made on an example that the foregoing rotation cumulative amount indicator device is mounted on an electric stapler.

In FIGS. 5 to 9, 1 is an electric stapler to be attached on a copier, for example. The electric stapler 1 is constructed with a stapler main body 10 and a cartridge 700 removably loaded within a cartridge chamber 25 formed inside the stapler main body 10.

The stapler main body 10 is provided with a table 100 for reciprocal movement, a table mechanism 150 for causing the table 100 to move reciprocally, a feed mechanism (not shown) for feeding the sheet staples S stacked within the cartridge 700 to a striking portion 720, a striking mechanism 300 for striking the staple S from the striking portion 720, a clincher mechanism (not shown) for clinching the tip of a struck staple, a drive mechanism 500 for driving a table mechanism 150, the feed mechanism and striking mechanism 300, and a detection mechanism (not shown) for detecting a position of the table 100.

[Drive Mechanism 500]

Figure 10:
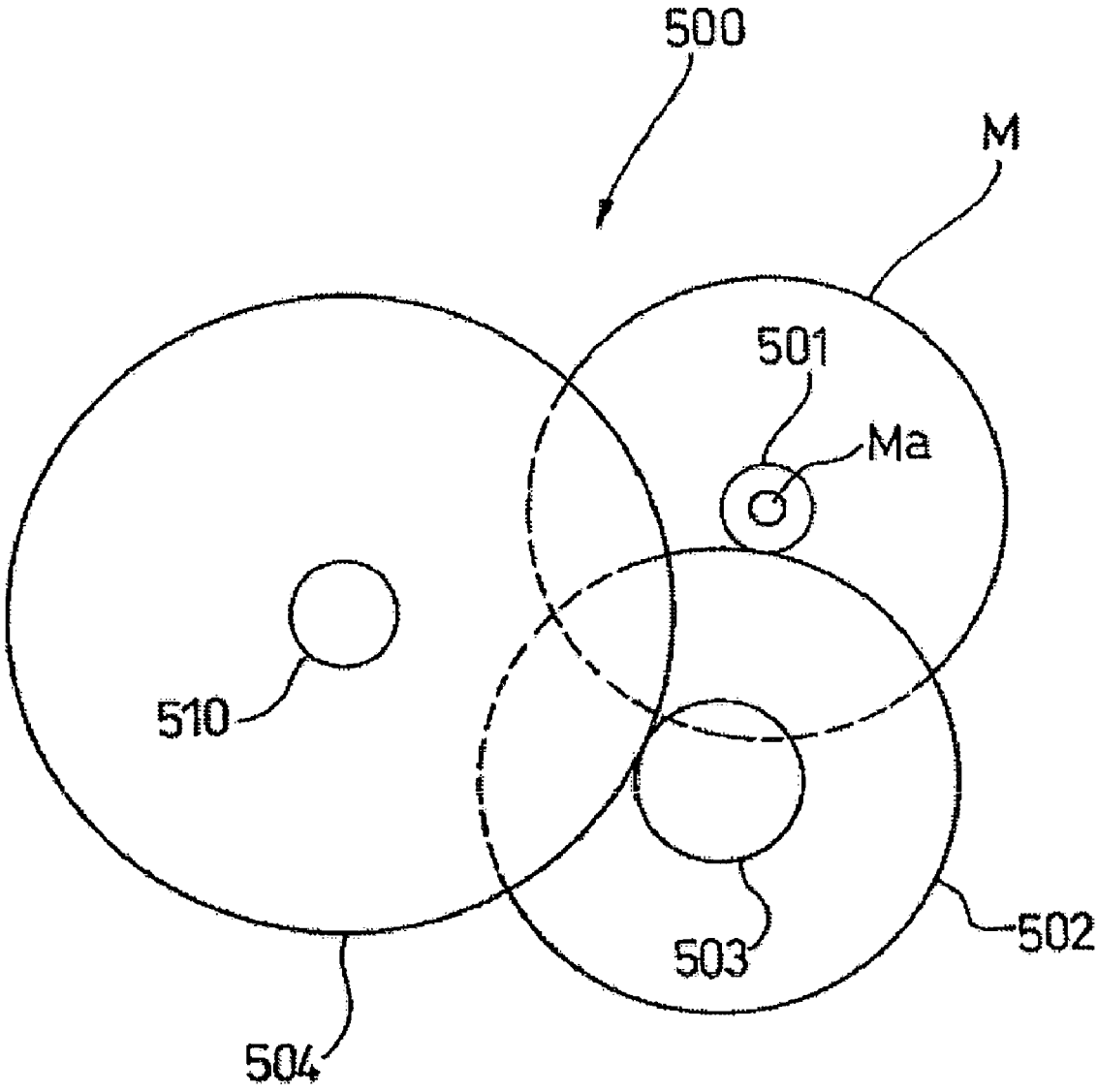
FIG. 10 is an explanatory view showing a drive mechanism.

The drive mechanism 500 is constructed, as shown in FIG. 10, with a motor M provided on the main body 10, a gear 501 attached on a drive shaft Ma of the motor M, an intermediate gear 502 in mesh with the gear 501, an intermediate gear 503 coupled to the intermediate gear 502, a drive gear 504 in mesh with the intermediate gear 503, and a cam drive shaft 510 for rotation together with the drive gear 504.

The cam drive shaft 510 is arranged to rotate clockwise (in FIG. 8) (rotate counterclockwise in FIG. 7) by driving the motor M through the gears 501–504.

Figure 11:
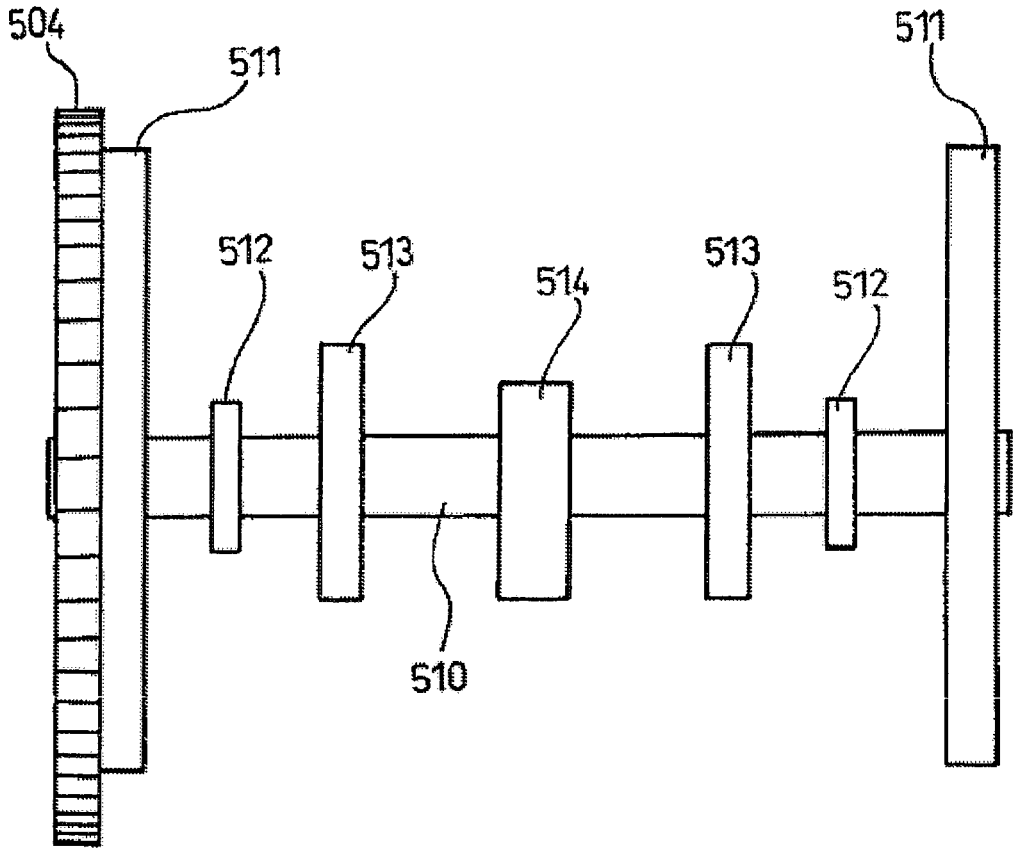
FIG. 11 is an explanatory view showing a cam attached on a cam shaft.

On the cam drive shaft 510, there are attached a pair of table cams 511, a pair of feed cams 512, a pair of driver cams 513 and a clincher cam 514, as shown in FIG. 11.

The cam drive shaft 510 has respective ends inserted in and rotatably held by bores 17 formed in the side plates 12, 13 of the frame 14. The intermediate gears 502, 503 are rotatably attached on the side plate 13 of the frame 13 (see FIG. 8).

Figure 7:
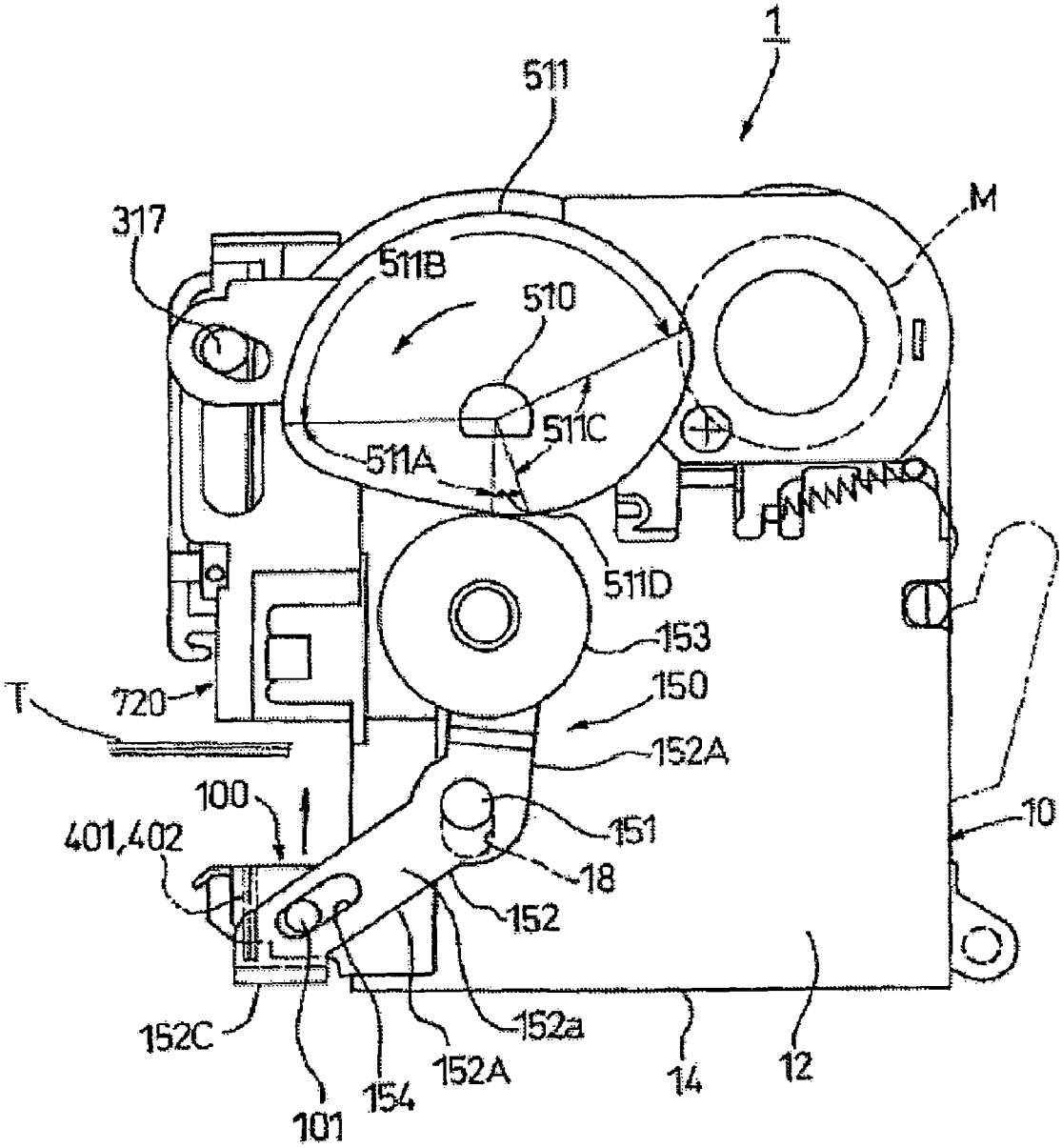
FIG. 7 is a right-side view of the electric stapler shown in FIG. 5.
Figure 8:
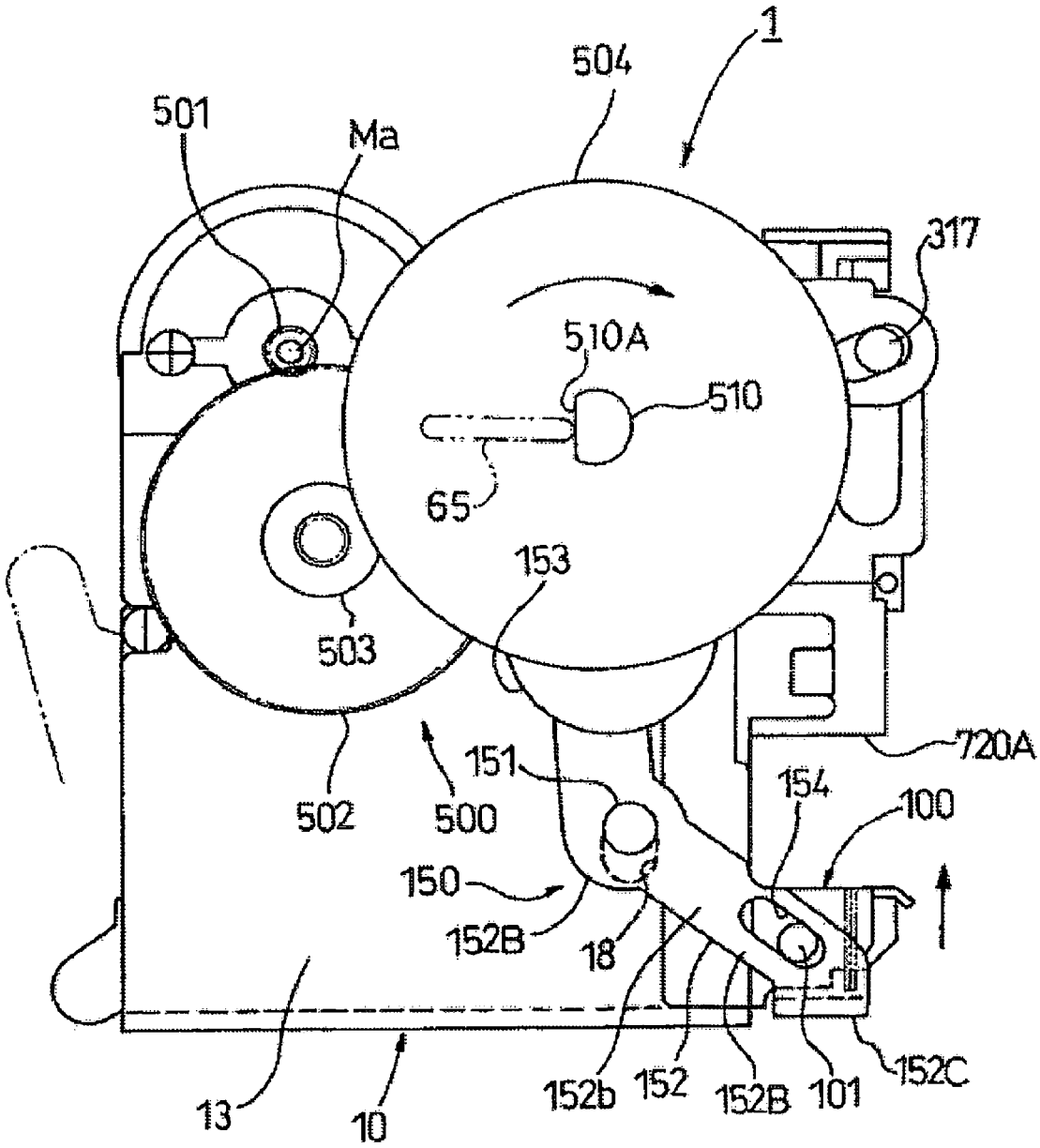
FIG. 8 is a left-side view of the electric stapler shown in FIG. 5.

The table 100 is provided for reciprocal movement on the stapler main body 10. As shown in FIGS. 7 and 8, it is to be moved reciprocally (moved vertically in FIGS. 7 and 8) by the table mechanism 150.

In the present embodiment, a rod 65 shown in embodiment 1 is provided in contact with the cam drive shaft 510, as shown in FIG. 8. The cam drive shaft 510 is convenient in accelerating the amount of wear of soft material of the rod 65. Incidentally, the increased diameter portion 60B shown in embodiment 2 can be provided on the cam drive shaft 510.

[Table Mechanism 150]

The table mechanism 150 has, as shown in FIG. 7, a link shaft 151 inserted for vertical movement in an elongate hole 18 of the side plate 12, 13 of the frame 14, a link member 152 for rotational movement about the link shaft 151, a table cam 511, and a roller in abutment against the peripheral surface of the table cam 511 and rotatably attached on an upper portion (in FIGS. 7 and 8) of the link member 152. The link member 152 is biased counterclockwise (in FIG. 7) by a not-shown spring so that the roller 153 is always kept in abutment against the peripheral surface of the table cam 511.

The table cam 511 has, as shown in FIG. 7, an increasing zone where the radius increases with rotation in the counterclockwise direction, a large radius zone 511B where the radius is maximized into a constant, a decreasing zone 511C where the radius decreases, and a small radius zone 511D where the radius is minimized.

The link member 152 is formed with side plates 152A, 152B fixingly holding the both ends of the link shaft 151, and a coupling plate 152C coupling between the lower ends of the side plates 152A, 152B. The lower portion of the side plate 152A, 152B than the link shaft 151 forms an arm 152*a*, 152*b* extending toward the table 100 in the obliquely forward. The arm 152*a*, 152*b* is provided with an elongate hole 154 extending along the arm. The elongate hole 154 is rotatably inserted by a shaft 101 provided on the table 100 so that the table 100 can be lifted in a direction of the arrow by rotating the link member 152 clockwise (in FIG. 7) about the link shaft 151.

The table 100 lies in a home position (initial position) shown in FIGS. 7 and 8 when the roller 153 is in abutment against the peripheral surface of the small radius zone 511D of the table cam 511. It ascends when the roller 153 goes into contact with the peripheral surface of the increasing zone 511A of the table cam 511, abuts against an underside 720A of the striking portion 720 when the roller 153 goes into abutment against the peripheral surface of the large radius zone 511B, and descends when the roller 153 goes into abutment against the peripheral surface of the decreasing zone 511.

Incidentally, the link shaft 151 is urged upward by a not shown spring so that it can move down in order not to cause trouble in rotation of the table cam 511 when the fastening sheet T is thick.

The table 100 is provided with clinchers 401, 402. The clinchers 401, 402 are rotated by a not-shown clincher mechanism, to clinch the tip of a sheet stable.

[Striking Mechanism 300]

Figure 9:
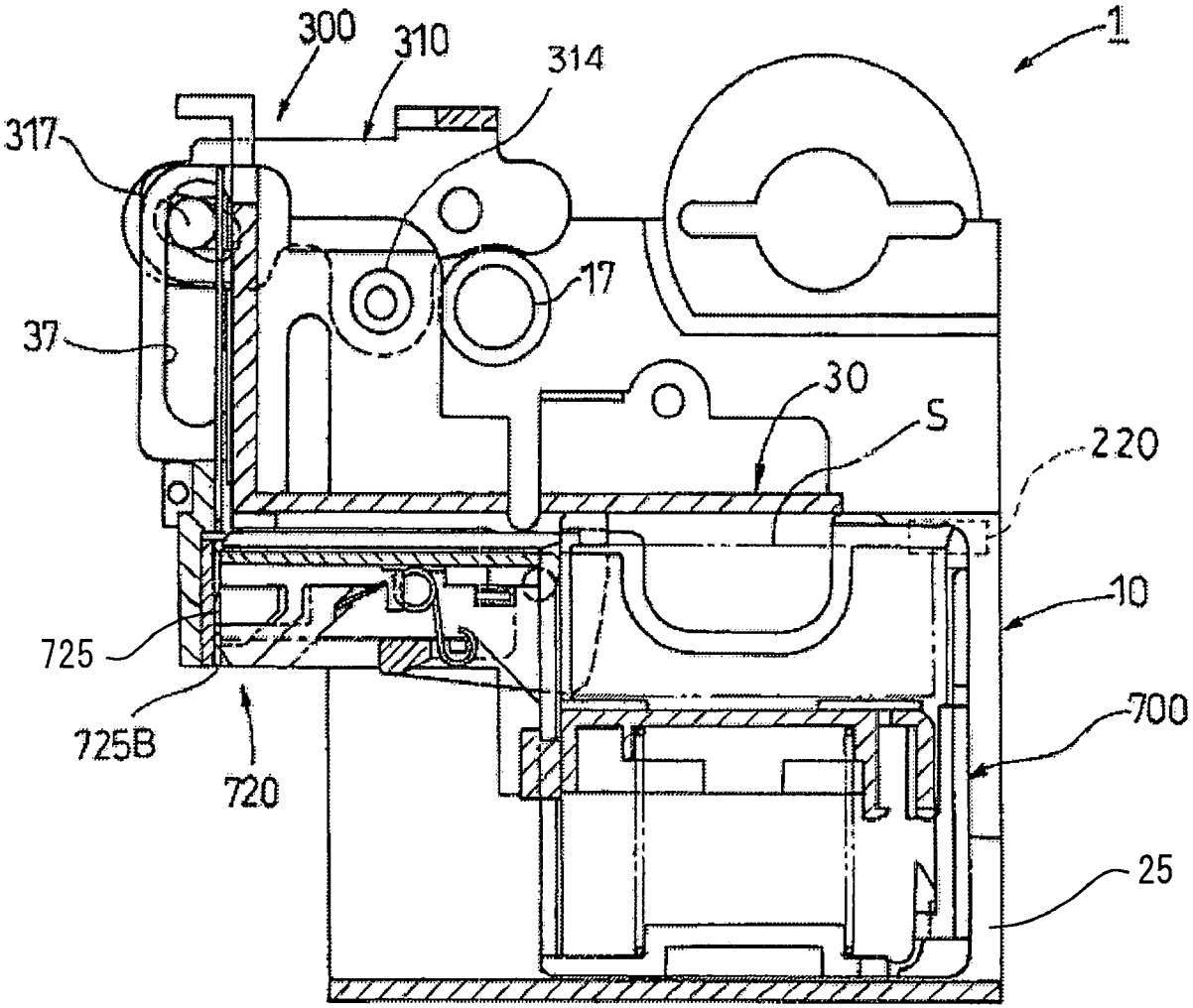
FIG. 9 is a sectional view of the electric stapler shown in FIG. 5.

The striking mechanism 300 is structured by a striking link 310 and a driver cam 513 (see FIG. 11) provided on the cam drive shaft 510, as shown in FIG. 9.

The striking link 310 is arranged to rotate about the shaft 314 by the driver cam 513 and a not-shown roller abutting against the driver cam 513. It reciprocally moves along the elongate hole 37 of the driver shaft 317 due to rotation of the striking link 310.

Figure 12:
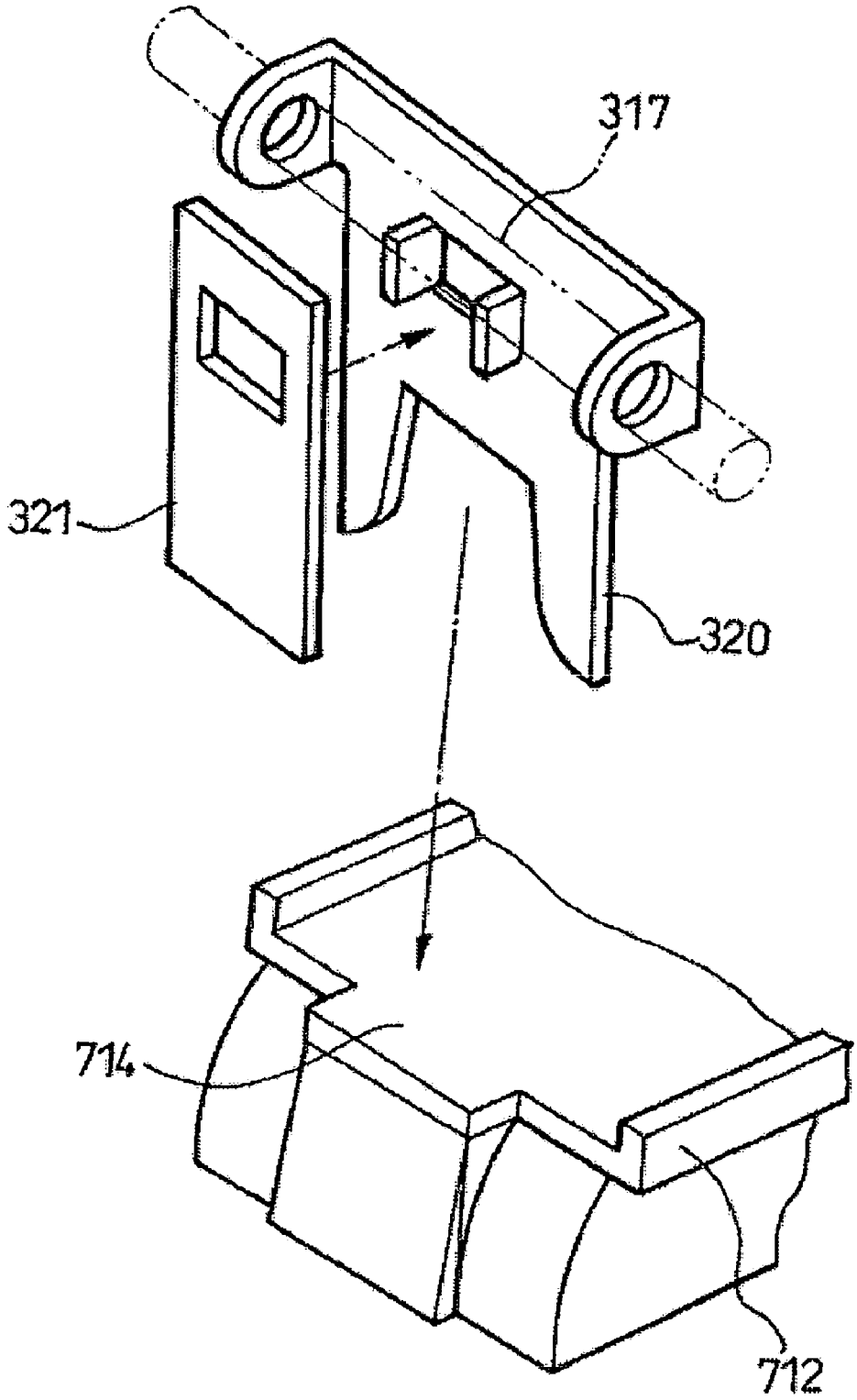
FIG. 12 is a perspective view for explaining a forming into a squared-U form by a forming plate.

The driver shaft 317 is attached with a forming plate 320 as shown in FIG. 12. The forming plate 320 is fit with a driver plate 321. Thus, the forming plate 320 and the driver plate 321 reciprocally move together with the driver shaft 317.

The forming plate 320 is to descend in a manner striding a protrusion 714 provided at a front end of a staple guide 712, referred later. By descending the forming plate 320, the staple fed onto the protrusion 714 is formed into a squared-U form. The driver plate 321 is to strike the staple formed in the squared-U form.

[Feed Mechanism]

Figure 13:
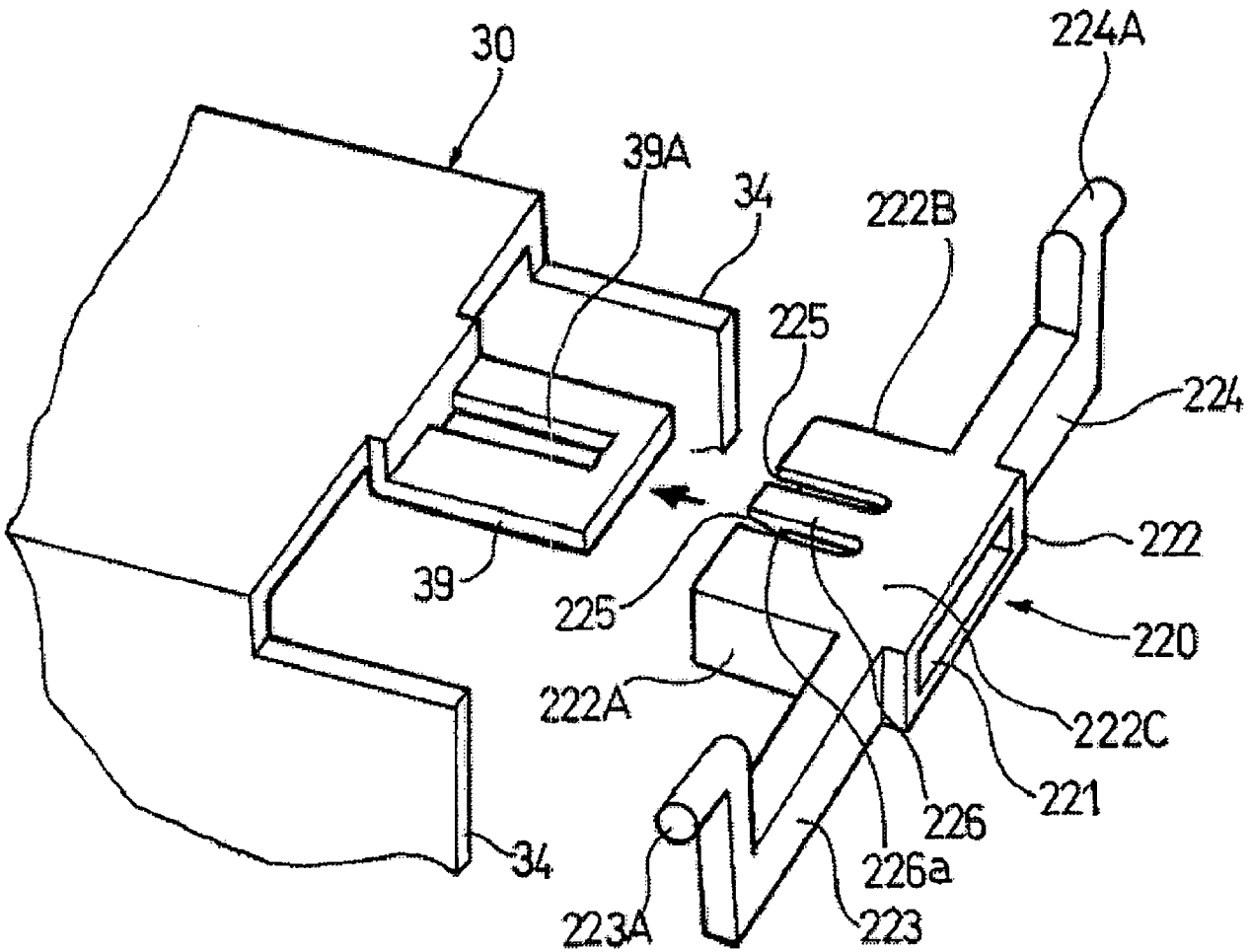
FIG. 13 is a perspective view showing a feed plate body.
Figure 14:
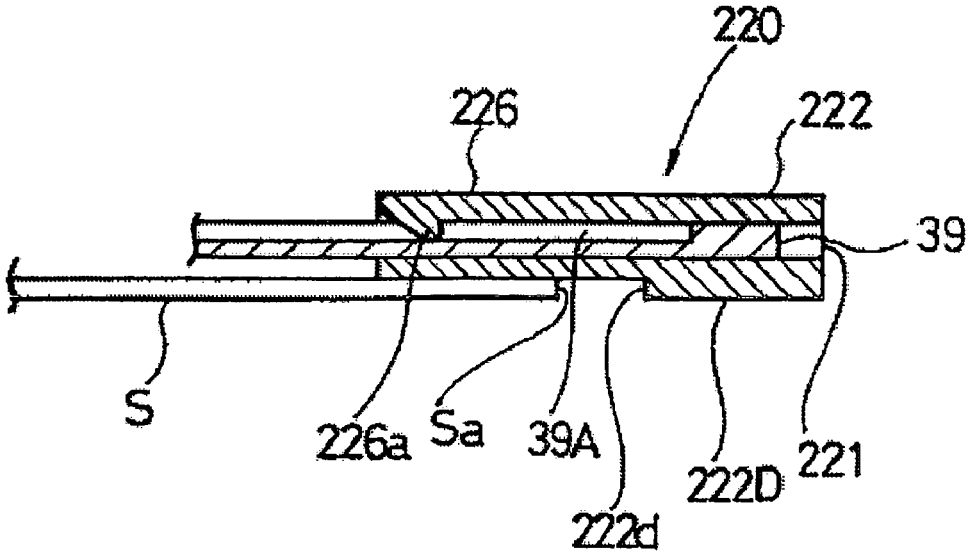
FIG. 14 is a sectional view showing the feed plate body.

The feed mechanism is structured with a feed cam 512 provided on the cam drive shaft 510 shown in FIG. 11, a feed plate body 220 shown in FIGS. 13 and 14, a rubber roller (not shown), a feed lever (not shown) for moving the feed plate body 220 back and forth in association with rotation of the feed cam 512, and so on.

The feed plate body 220 has, as shown in FIGS. 13 and 14, a housing 222 forming a through-hole 221 in which is inserted a guide plate 39 provided on a magazine 30 of the stapler main body 10, and arms 223, 224 extending toward the sidewall 34, 34 of magazine 30 from the sidewall 222A, 222B of housing 222. Two slits 225 are provided in the top wall 222C of the housing 222, to form an elastic piece 226 by the two slits 225. The elastic piece 226 is provided with a projection 226*a* for engagement with a guide groove 39A of the guide plate 39. Meanwhile, in a feed plate 222D as a bottom wall of the housing 222, a step (abutment point) 222*d* is formed for abutment against a rear end Sa of the sheet staple S.

The arm 223, 224 is provided with a shaft 223A, 224A coupled to a not-shown feed lever so that the feed plate body 220 can be moved back and forth by the feed cam 512 and feed lever. By a forward movement of the feed plate body 220, the step 222*d* of the feed plate 222D is abutted against the rear end Sa of the sheet staple S in the uppermost layer stacked within the cartridge 500 thereby feeding the sheet staple forward.

[Operation of Electric Stapler]

Now, explained is the operation of the electric stapler 1 constructed as above.

At first, the cartridge 700 stacked with sheet staples S is loaded in a cartridge chamber 25 of the stapler main body 10 by being inserted from the rear. This loading is quite easy because the loading requires a mere insertion from the rear.

When the motor M is not driven, the table 100 is in the initial position shown in FIG. 7. The table cam 511 also is in the initial position shown in FIG. 7 wherein the roller 153 abuts against the small radius zone 511D of the table cam 511.

When the motor M is driven on a fastening signal of from the copier, the cam drive shaft 510 rotates counterclockwise (in FIG. 7) through the gears 501–504, to rotate the cams 511–514 together with the cam drive shaft 510.

When the roller 153 begins to abut against the peripheral surface of the increasing zone 511A from the small radius zone 511D of the table cam 511 due to rotation of the table cam 511, the link member 152 rotates clockwise about the shaft 151, thus causing the table 100 to ascend.

As the table 100 ascends, the feed plate body 220 is moved forward by the feed cam 512 and feed lever. By the movement, the feed plate 222D at its step 222*d* goes into abutment against the rear end Sa of the sheet staple S in the uppermost layer stacked within the cartridge 700. Namely, in the initial stage the cartridge is loaded, the sheet staple S is fed a predetermined amount from the cartridge 700 by the feed plate 222D and further fed forward by rotation of a not-shown rubber roller.

Then, when the roller 153 begins to abut against the peripheral surface of the large radius zone 511B of the table cam 511, i.e. when the cam drive shaft 510 rotates nearly 90 degrees, the table 100 ascends up to the underside 720A (top dead center) of the striking portion 720, to clamp the sheets of paper T.

Figure 15A:
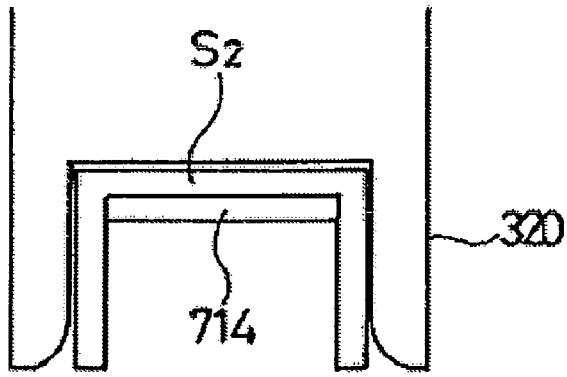
Figure 15B:
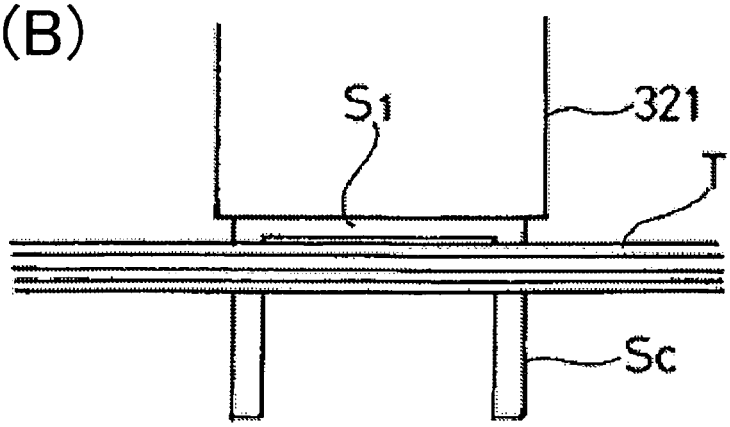
FIG. 15(B) is an explanatory view showing a state that a staple is driven and penetrated through sheets of paper.

In the duration the roller 153 abuts against the peripheral surface of the large radius zone 511B of the table cam 511, the table 100 stays at the top dead center thus keeping the sheets of paper T in a clamped state. In the duration the sheets of paper T are clamped, the forming plate 320 and driver plate 321 further descends together with the driver shaft 317. Thus, the forming plate 320 and driver plate 321 intrudes into a gap 725 of the striking portion 720. In the case there is a staple S1, S2 in the gap 725, the forming plate 320 forms the staple S2 into a squared-U form as shown in FIGS. 15(A) and 15(B). The driver plate 321 strikes the staple S1 formed in the squared-U form out of a striking port 725 of the striking portion 720.

When the staple S1 is driven, the clincher 401, 402 is rotated by the not-shown clincher mechanism thereby clinching the leg Sc of the sheet staple S1. Thereafter, the roller 153 goes into abutment against the peripheral surface of the decreasing zone 511C of the table cam 511, to descend the table 100 and return it into the home position.

In the present embodiment, although the rod 65 is provided in contact with the outer peripheral surface of the cam drive shaft 510 as was shown in FIG. 8, the rod 65 at its tip is formed of a soft material. Accordingly, the tip of the rod 65 is worn in a long term use. Particularly, because the planer region 510A is formed in the cam drive shaft 510, an impacts is to be applied to the tip of the rod 65 thus accelerating the amount of wear of the soft material. In case the soft material at the tip of the rod 65 is worn, the rod 65 moves in a manner approaching the cam drive shaft 510, thereby rotating the gauge lever 67 (see FIG. 1). By reading a position of the scale as indicated by the tip of the gauge lever 67 at that time, it is possible to know a rotation cumulative amount of the cam dive shaft 510.

As described above, in the present embodiment, by urging the rod 65, it goes into contact with the rotary member (cam drive shaft 510) provided in the drive mechanism, thereby measuring a rotation cumulative amount. Due to this, the rod 65 constitutes for a detection mechanism to detect a consumed amount in the electric stapler drive mechanism.

(Embodiment 4)

Figure 16:
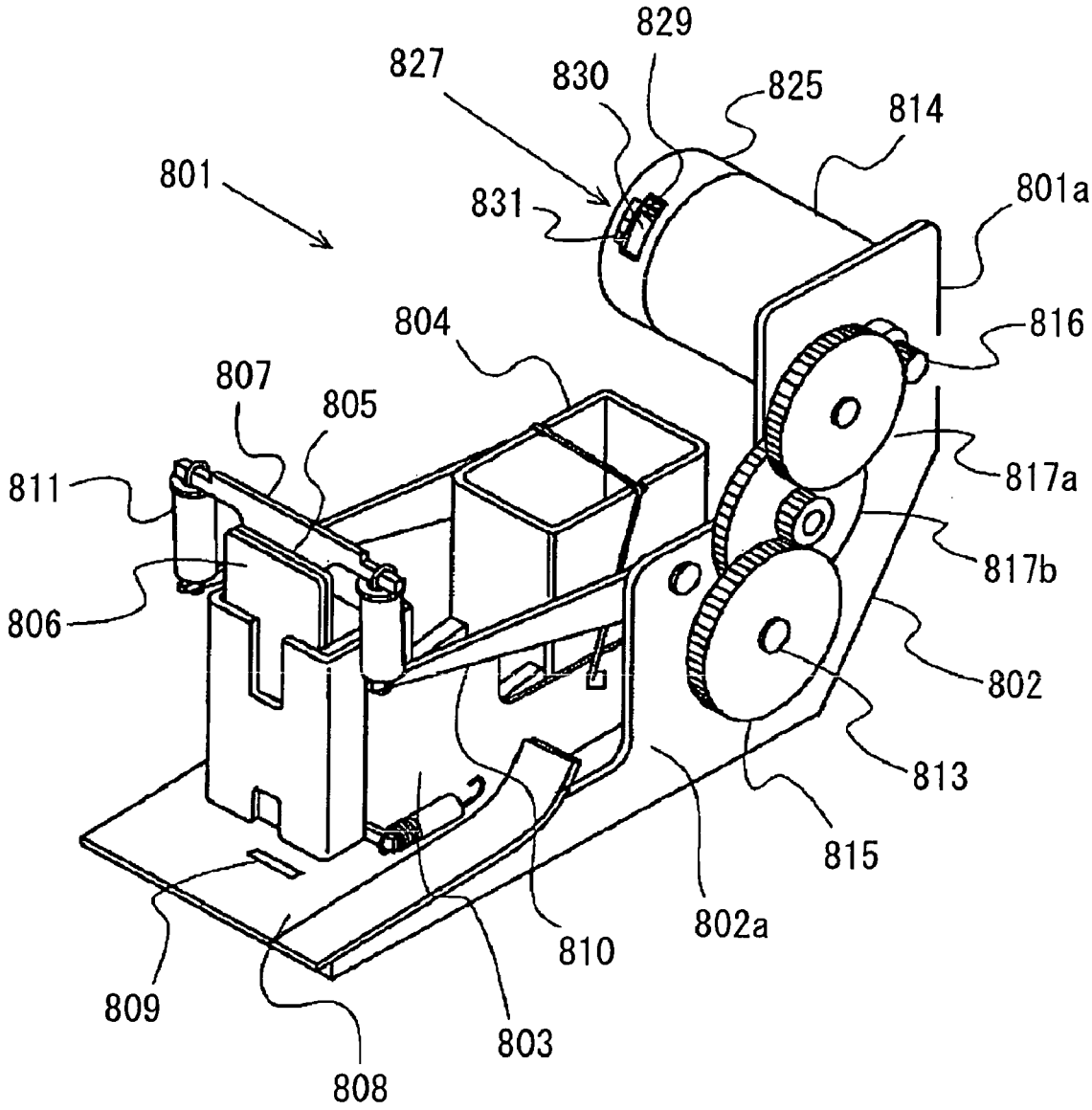
FIG. 16 is a perspective view of an electric stapler the cumulative-drive indicator mechanism of the invention is applied.

Now, explained is embodiment 4 of the invention on the basis of FIGS. 16 to 21. FIG. 16 shows an electric stapler to which the cumulative-drive indicator mechanism of the invention is applied. The electric stapler 801 is provided with a magazine 803 rotatably supported in the rear by a frame 802. Inside the magazine 803, there is loaded a staple cartridge 804 charged with a plurality of sheet staples. In the underneath of the magazine 803, there is formed a feed mechanism for sequentially feeding the straight-formed staples contained stacked within the staple cartridge 804 to the striking portion. In the striking portion, there is arranged a striking mechanism constructed by a forming plate 805 for forming a straight-formed staple into a squared-U form, a driver plate 806 for striking the squared-U staple toward sheets of paper, and an operation member 807 holding the forming plate 805 and the driver plate 806 in a superposed state. Below the frame 802, there is formed a table 808 on which sheets of paper are to be rested. In front of the table 808, a clincher mechanism 809 is formed to bend, along a paper backside, the leg of a staple struck by the driver plate 806 and penetrated through the fastening paper.

The operating member 807 holding the forming plate 805 and driver plate 806 is coupled through a coupling piece 811 to one end of an operation arm 810 having a central portion rotatably supported on the sidewall of the frame 802. By rotating the operation arm 810 due to the cam mechanism formed on the other end of the operation arm 810, the driver plate 806 and the forming plate 805 are operated through the operation member 807. The cam mechanism for operating the operation arm 810 is attached on the drive shaft 813 supported by the sidewall 802*a* of the frame 802. The cam mechanism is rotatively driven by the drive shaft 813, to operate the driver plate 806 and forming plate 805 through the operation member 807.

On a sidewall 802*a* of the frame 802 supporting the drive shaft 813, attached is an electric motor 814 for rotatively driving the drive shaft 813. The drive shaft 813 and the output shaft of the electric motor 814, that penetrate the sidewall 802*a*, have ends respectively attached with an operation gear 815 and a drive gear 816. Between the operation gear 815 and the drive gear 816, a reduction gear 817 is arranged to convey the rotation of the electric motor 814 to the drive shaft through speed reduction. The reduction gear 817 is constituted by two gears, i.e. a first reduction gear 817*a* in mesh with the drive gear 816 attached on the output shaft of the electric motor 814 and a second reduction gear 817*b* in mesh with the operation gear 815 attached on the drive shaft 813.

As shown in FIGS. 17 to 20, within the electric motor, there are provided a pair of brushes 823 in a manner elastically contacting with the outer peripheral surface of a rectifier 821 (i.e. rotating part of the electric motor) formed integral with the drive shaft 820. The brush 823 is supported by an electrically-conductive elastic piece 824 and urged toward the drive shaft of the motor 814. Meanwhile, the electrically-conductive elastic piece 824 has an end connected to a terminal 826 arranged lateral external of the motor case 825. Within the electric motor 814, a cumulative-drive indicator mechanism 827 is formed for indicating an aggregate drive state of the electric motor 814 in terms of a wear amount of the brush 823.

The cumulative-drive indicator mechanism 827 is constructed by an actuator 828 that displaces in accordance with a wear amount of the brush 823 of the electric motor 814, an aperture 830 formed in the motor case 825 in order to expose a pointer end 829 (pointer) formed at one end (second end) of the actuator 828 to the outside of the electric motor 814, and a limit mark 831 (scale) indicative of a wear limit of the brush 823 denoted around the aperture 830. The actuator 828 is formed of an insulator such as a plastic material, to have a center portion rotatably supported on a support shaft 832 formed integral with the motor case 825. The pointer end 829 formed at the one end of the actuator 828 is arranged within the aperture 830 formed in the peripheral surface of a cylindrical portion of the motor case 825. The actuator 828 has the other end (first end) formed with a contact piece 833 for abutment against a backside of the elastic piece 824 holding the brush 823. By a spring 834, the contact piece 833 is rotatively urged in a direction of abutment against the backside of the elastic piece 824 of the brush 823.

Figure 17:
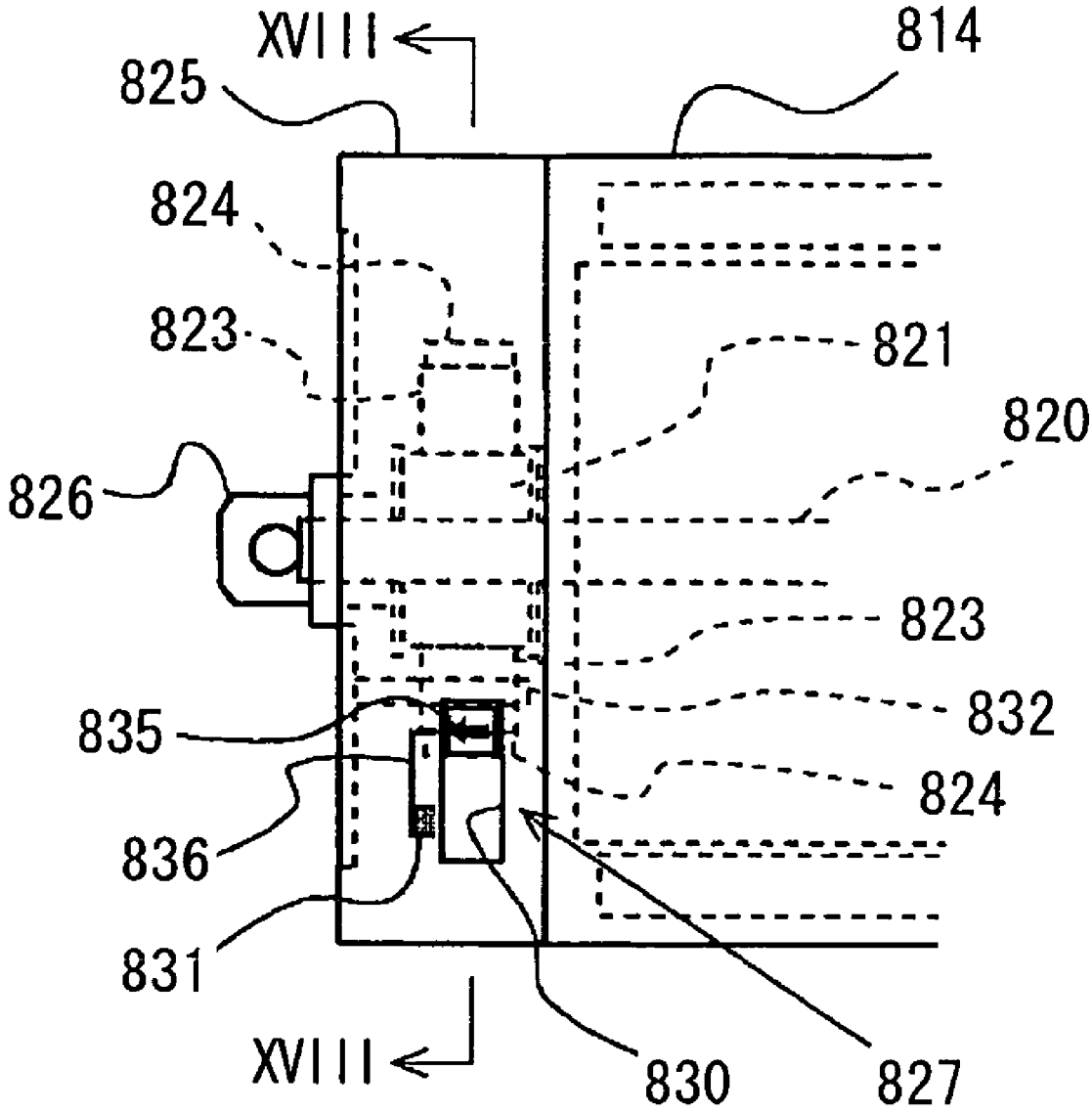
FIG. 17 is a side view showing a cumulative-drive indicator mechanism formed in the electric motor of FIG. 16.
Figure 18:
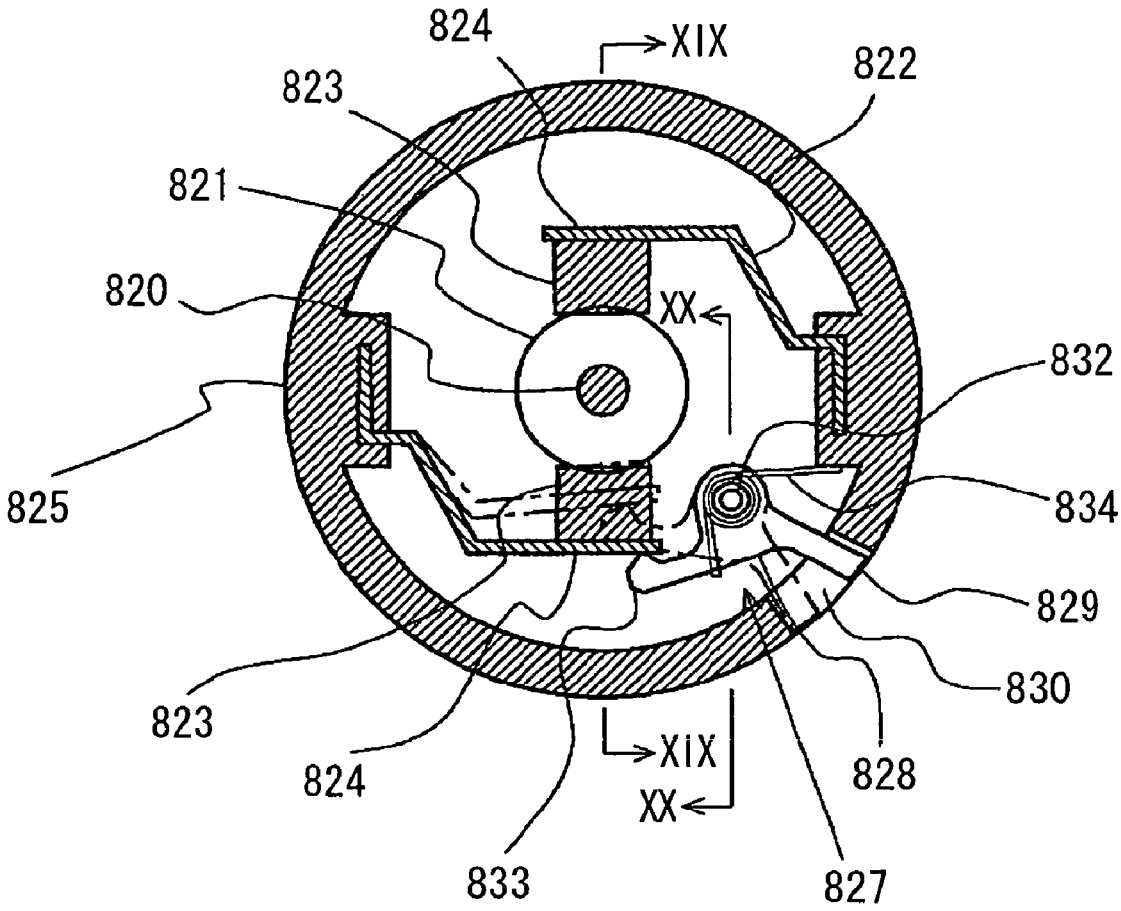
FIG. 18 is a vertical sectional side view online XVIII—XVIII in FIG. 17 showing the cumulative-drive indicator mechanism.
Figure 19:
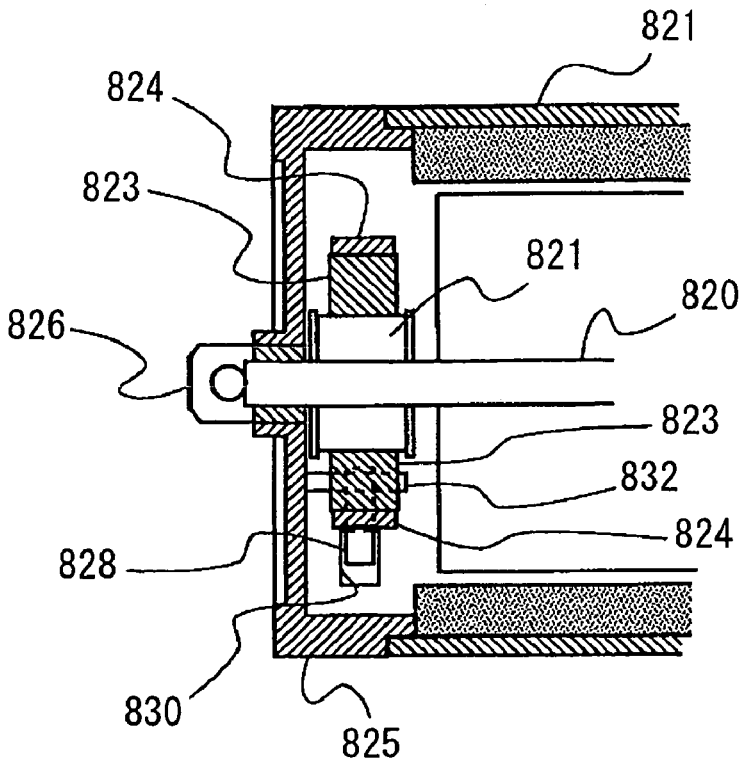
FIG. 19 is a sectional view on line XIV—XIV in FIG. 18.
Figure 20:
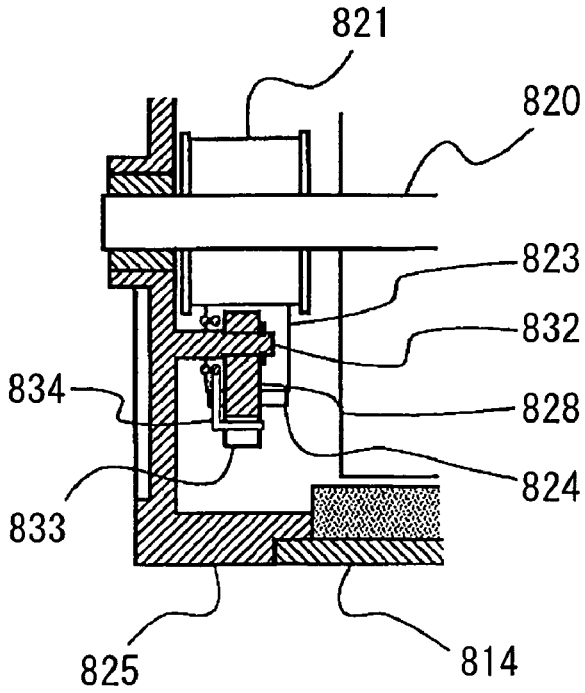
FIG. 20 is a sectional view on line XX—XX in FIG. 18.

As shown in FIG. 17, a mark 835 such as an arrow is formed at an end face of the pointer end 829 of actuator 828 arranged in the aperture. In the peripheral edge of the aperture 830, there is indicatively formed a scale line 836 and a limit mark 831 representative of an endurance limit, correspondingly to the mark 835. Due to a wear of the brush 823 in pressure-contact with the rectifier 821 of the electric motor 814, the elastic piece 824 displaces in a direction approaching an outer peripheral surface of the rectifier 821. The contact piece 833 of actuator 828 in abutment against the backside of the elastic piece 824 displaces following the displacement of the elastic piece 824 whereby the actuator 828 rotates about the support shaft 832 thus displacing the pointer end 829 of actuator 828 within the aperture 830. This displacement position enables to grasp a wear amount of the brush 823 by means of the scale line 836 and limit mark 831 shown around the aperture 830. Setting is made such that the mark 835 at the pointer end 829 displaces up to a position of the limit mark 831 when the wear amount of the brush reaches its limit. For the scale line 836 and limit mark 831, indication can be definitely recognized by making a display with coloring, e.g. indicated in yellow is a warning representative of a nearing to the endurance limit, and indicated in red is the limit mark 831 representative of the endurance life already reached.

Figure 21:
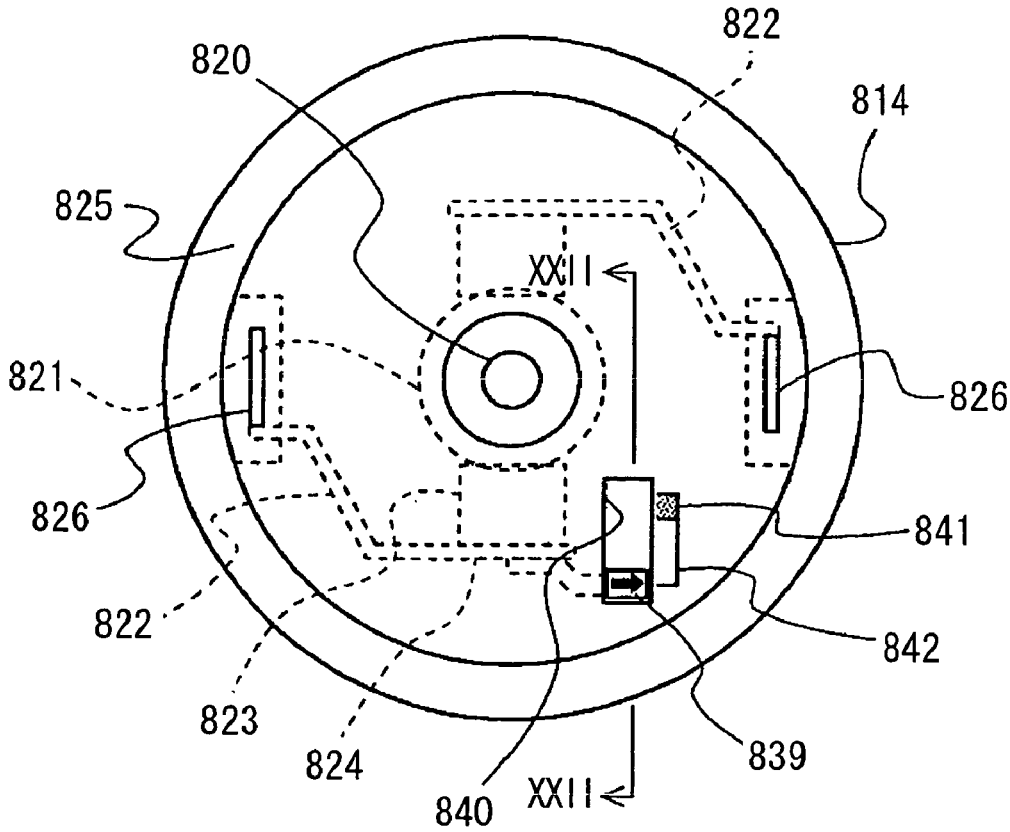
FIG. 21 is a side view showing an embodiment of another cumulative-drive indicator mechanism of the invention.
Figure 22:
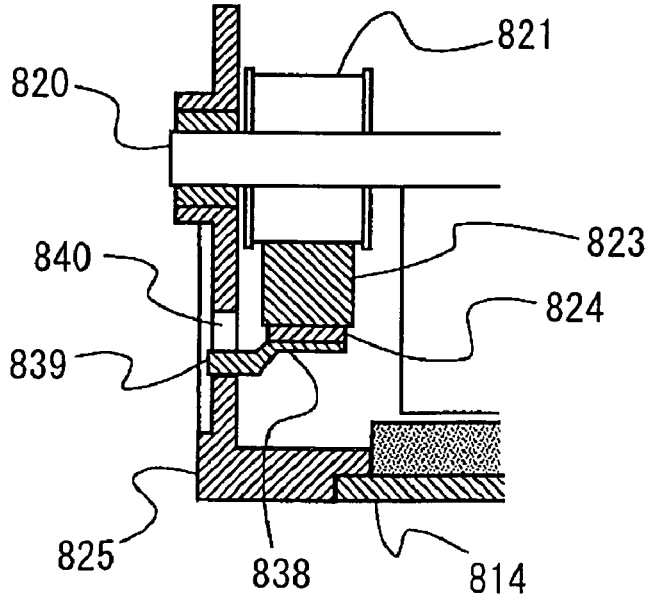
FIG. 22 is a sectional view on line XXII—XXII in FIG. 21 of the same cumulative-drive indicator mechanism as in FIG. 21.

FIGS. 21 and 22 show another embodiment of the invention. In the cumulative-drive indicator mechanism 827 of this embodiment, the actuator 838 has one end fixed to an elastic piece 824 holding the brush 823. The actuator 838 has the other end formed with a pointer end 839 exposed outward of the electric motor 814 through a lateral end face of the motor case 825. The motor case 825 has, in its side end face, an aperture 840 formed along a direction of displacement of the pointer end 839. In the peripheral edge of the aperture 840, there is indicated a scale line 842 and limit mark 841 along the direction of displacement of the pointer end 839. Following a wear of the brush 823, the elastic piece 824 holding the brush 823 displaces. The pointer end 839 of the actuator 838 attached on the elastic piece 824 displaces within the aperture 840. By making the displaced position of the pointer end 839 correspond to the scale line 842 and limit mark 841 indicated in the periphery of the aperture 840, it is possible to grasp a cumulative-drive state of the electric motor through a wear amount of the brush 823.

As described above, in the present embodiment, the brush 823 goes into contact with the rotary member (rectifier 821 formed integral with the drive shaft 820) provided in the drive mechanism, thereby measuring a cumulative-drive state. This constitutes a detection mechanism for detecting a consumed amount of the electric stapler drive mechanism.

Although the above embodiment explained on the case of using the electric stapler attached on the copier, this is not limitative, e.g. it can be used by being attached on a printer, facsimile or the like.

Meanwhile, the invention is not limited to the foregoing embodiments but can be variously modified within the technical scope of the invention wherein it is natural that the invention is applicable to such modifications.

The present application is based on Japanese Patent application (Japanese Patent Application No. 2002-117831) filed on Apr. 19, 2002 and Japanese Patent application (Japanese Patent Application No. 2002-214263) filed on Jul. 23, 2002, the contents of which are hereby incorporated herein by reference.

INDUSTRIAL APPLICABILITY

As explained above, according to the present invention, in case the rotary shaft rotates over a long term, the soft material is worn to thereby move the rod. By detecting and indicating the amount of movement, it is easy to decide in what degree the rotation cumulative amount of the rotary shaft is neared to the limit value.

Meanwhile, according to the invention, there is provided an actuator that displaces in accordance with a wear amount of an electric motor brush. The actuator has a pointer end exposed for being viewed from the external of the electric motor. Furthermore, an cumulative-drive indicator mechanism, for indicating a limit mark along a direction of displacement of the pointer end, is formed in the electric motor for driving the electric stapler. Accordingly, it is possible to correctly detect a driven state of the electric stapler in the apparatus installing the electric stapler without removing the electric stapler from the apparatus. Meanwhile, in the case of removal from the copier, the endurance life can be detected by the electric stapler singly. Therefore, it is possible to grasp an endurance life of the electric stapler and exchange it in a suitable time. It is possible to prevent the occurrence of a failure due to an endurance life of the electric stapler during use of the apparatus or the damping of the electric stapler not yet reached its endurance time, thus contributing to resource saving.

The invention claimed is:

1. An electric stapler comprising:

a feed mechanism for sequentially feeding a staple from a magazine loaded with a plurality of staples to a striking portion;

a striking mechanism for striking the staple, that is fed to the striking portion, toward sheets of paper by a driver plate;

a clincher mechanism for bending a staple leg struck by the driver plate and penetrated through the sheets of paper, along a backside of the sheets of paper;

a drive mechanism for driving at least one of the feed mechanism, the striking mechanism and the clincher mechanism by rotation of at least one electric motor;

a detection mechanism that contacts with a rotary member connected to said electric motor in the drive mechanism, the detection mechanism detecting a rotation cumulative amount of the drive mechanism; and an indicator mechanism for indicating the rotation cumulative amount detected by the detection mechanism.

2. The electric stapler according to claim 1, wherein the detection mechanism is urged onto the rotary member.

3. The electric stapler according to claim 1, wherein the indicator mechanism further comprises:

a pointer that contacts the detection mechanism and indicates a displacement from an initial contact position with the detection mechanism at a start of using the electric stapler, and a scale for indicating the rotation cumulative amount of the drive mechanism cooperatively with the pointer.

4. The electric stapler according to claim 1, wherein the pointer is provided in a visible location externally of the electric stapler.

5. The electric stapler according to claim 1, wherein the detection mechanism comprises:

a rod vertically movable with respect to the rotary member, and an urging member for urging the rod toward the rotary member and putting the rod in contact with an outer surface of the rotary member, wherein at least one of the rotary member and the rod is formed of a material softer than a material of the other, and the indicator mechanism indicates a wear amount of the softer material.

6. The electric stapler according to claim 5, wherein the outer surface of the rotary member is formed of a material softer than a contact region of the rod contacting with the rotary member.

7. The electric stapler according to claim 5, wherein the rod is formed of a material softer than the outer surface of the rotary member, and a cutout is formed in a part of an outer peripheral surface of the rotary member, wherein the outer peripheral surface contacts with the rod.

8. The electric stapler according to claim 5, wherein the detection mechanism further comprises:

a radius increased zone provided at a tip of the rotary member and formed of a material softer than the rod.

9. The electric stapler according to claim 1, wherein the rotary member is a rotary part of the electric motor, wherein the detection mechanism comprises a brush in contact with the electric motor, and the indicator mechanism comprising an actuator having a first end biased to maintain in contact with the brush so that the actuator is displaced due to wear of the brush and a second end as a pointer to indicate a displacement of the actuator.

10. The electric stapler according to claim 9, wherein the second end is visible at an outer surface of the electric motor so that recommended maintenance of the electric stapler is indicated when a position of the second end corresponds to a marked position on the outer surface of the electric moter.

11. An electric stapler according to claim 9, wherein the indicator mechanism further comprises an elastic piece for urging the brush in a direction toward a drive shaft of the motor, and the indicator mechanism further comprises a spring rotatively urging the first end of the actuator in a direction contacting with a backside of the elastic piece.

* * * * *